United States Patent [19]

Rao et al.

[11] Patent Number: 4,652,706

[45] Date of Patent: Mar. 24, 1987

[54] DOUBLE POLE SWITCH CONSTRUCTION

[75] Inventors: Chepur P. Rao, North Kingstown; Juan J. Barrena, Providence, both of R.I.

[73] Assignee: Tower Manufacturing Corporation, Providence, R.I.

[21] Appl. No.: 823,689

[22] Filed: Jan. 29, 1986

[51] Int. Cl.[4] ..... H01H 5/24; H01H 13/06

[52] U.S. Cl. ..... 200/67 D; 200/302.2; 200/1 R; 200/6 R; 74/100 P

[58] Field of Search ..... 200/67 D, 67 DA, 67 R, 200/302.2, 302.1, 5 R, 6 R, 6 C, 157, 1 R; 74/100 P

[56] References Cited

U.S. PATENT DOCUMENTS

| | | | |
|---|---|---|---|
| 2,181,068 | 11/1939 | Riche | 74/100 P |
| 2,182,856 | 12/1939 | Riche | 74/100 P |
| 2,295,456 | 9/1942 | Eaton | 335/348 |
| 2,354,027 | 7/1944 | Kaminky | 200/67 D |
| 2,370,479 | 2/1945 | Meyer | 200/67 R |
| 2,468,673 | 4/1949 | Kaminky | 74/519 |
| 2,469,686 | 5/1949 | Eaton | 200/67 D |
| 2,495,349 | 1/1950 | Rohr | 200/67 D |
| 2,700,079 | 1/1955 | Haydon | 200/67 DA |
| 2,701,475 | 2/1955 | Readeker | 74/100 P |
| 2,743,331 | 4/1956 | Lauder et al. | 200/67 R |
| 2,750,463 | 6/1956 | Roeser | 200/67 D |
| 2,774,836 | 12/1956 | Powers | 200/67 D |
| 2,814,686 | 11/1957 | Wilder | 200/67 D |
| 2,840,656 | 6/1958 | Roeser | 200/67 DA |
| 3,056,866 | 10/1962 | Karleen | 200/67 D |
| 3,094,594 | 6/1963 | Watson | 200/302.2 X |
| 3,319,021 | 5/1967 | Good | 200/67 D |
| 3,381,197 | 4/1968 | Waters et al. | 200/67 D |
| 3,497,649 | 2/1970 | Ball | 200/67 D |
| 3,735,069 | 5/1973 | Andresen | 200/67 D |
| 3,989,914 | 11/1976 | Stearley et al. | 200/67 D |
| 4,209,677 | 6/1980 | Brown | 200/67 D |
| 4,427,006 | 1/1984 | Nottke | 200/302.1 X |

*Primary Examiner*—Stephen Marcus
*Assistant Examiner*—Ernest G. Cusick
*Attorney, Agent, or Firm*—Salter & Michaelson

[57] ABSTRACT

A switch construction comprises a waterproof housing and first and second contact assemblies in the housing which are operative for effecting and interrupting electrical continuity in first and second lines, respectively, of an electrical circuit connected to the switch. The switch is operable by manually depressing a rubberized cover on the housing to effect continuity in the first and second contact assemblies; and when pressure is released from the cover, the contact assemblies are resiliently returned to their original positions and continuity is interrupted in the switch.

9 Claims, 8 Drawing Figures

DOUBLE POLE SWITCH CONSTRUCTION

BACKGROUND AND SUMMARY OF THE INVENTION

The instant invention relates to electrical switching devices and more particularly to a waterproof switching device which is adapted for use in small appliances for simultaneously interrupting the electrical continuity in two different lines of an electrical circuit.

Public awareness in the area of consumer safety has increased significantly over the past several years; and, as a result, it has been found to be necessary to modify or redesign many items, such as small appliances, in order to make them safer for consumers. In particular, it has been found to be necessary to redesign many small electrical appliances, such as hair dryers and the like, in order to prevent consumers from being accidentally electrocuted in the event that such items are inadvertently short circuited with water. For example, heretofore it was possible for a consumer to be accidentally electrocuted in a bathtub if an appliance such as a hair dryer was accidentally dropped into the water. Further, heretofore an accident of this type was possible even if the switch on the appliance which was dropped into the water was in off position, since in most cases it was possible for water to produce a short circuit between otherwise interrupted electrical terminals in the appliance.

As a result of the need to redesign small appliances so that they are safer to operate and, in particular, so that consumers operating them are less likely to be electrocuted, a need has developed for an effective switching device which can be reliably used on a small appliance but which is not normally short circuited when it is immersed in a pool of water. Still further, a need has developed for a waterproof switching device of this general type which is adapted for operating an appliance at two different speeds but which must be manually held in a depressed position in order to maintain the appliance in an energized state.

Devices representing the closest prior art to the instant invention of which the applicants are aware are disclosed in the U.S. Pat. Nos. 2,181,068; to Riche 2,182,856; Eaton 2,295,456; Kaminky 2,354,027; Meyer 2,370,479; Kaminky 2,468,673; Eaton 2,469,686; Rohr 2,495,349; Haydon 2,700,079; Readeker 2,701,475; Lauder et al. 2,743,331; Roeser 2,840,656; Karleen 3,056,866; and Brown 4,209,677. However, since these devices fail to suggest a device having first and second contact assemblies of the type embodied in the switch of the instant invention, and since they also fail to suggest a device which can effectively perform the functions of the switch of the instant invention, they are believed to be of only general interest.

The instant invention provides an effective improved switching device which can be utilized for small electrical appliances, such as hair dryers and the like, and which overcomes many of the disadvantages of the heretofore-available switching devices. Specifically, the switching device of the instant invention comprises a housing, a first contact assembly in the housing which is operable for effecting and interrupting electrical continuity between first and second terminals on the exterior of the housing, and a second contact assembly in the housing which is operable for effecting and interrupting electrical continuity betweeen third and fourth or third and fifth electrical terminals on the exterior of the housing. The housing preferably comprises a waterproof housing having a main casing and a cover which is received on the casing and is deformable for manually actuating the first and second contact assemblies. The first contact assembly preferably comprises a fixed contact which is electrically connected to the first electrical terminal on the exterior of the housing and a resiliently movable stressed contact member which is electrically connected to the second terminal on the exterior of the housing. The stressed contact member has a free end, and it is constructed so that it is resiliently movable with a snap action between a first position wherein the free end thereof is spaced from the fixed contact and a second position wherein the free end thereof is in engagement with the fixed contact. The main portion of the stressed contact member is preferably integrally struck from a resilient sheet metal, and it preferably comprises a center leaf and two side leaves. The center and side leaves preferably have first ends which are integrally connected adjacent the free end of the stressed contact member and second ends which are secured in the switch so that the two side leaves are in compression and the center leaf is in tension in order to make the stressed contact member operable with a snap action. The second contact assembly preferably comprises a resiliently movable actuator contact member which is electrically connected to the third terminal on the exterior of the housing, a resiliently movable first blade member which is electrically connected to the fourth terminal on the exterior of the housing, and a resiliently movable second blade member which is electrically connected to the fifth terminal on the exterior of the housing. The actuator contact member is mounted in the housing so that it is electrically insulated from the stressed contact member but so that it is depressible to move the stressed contact member from the first position thereof to the second position thereof. The first and second resilient blade members are mounted in spaced relation in the housing so that they are each independently depressible to positions of engagement with the actuator contact member wherein the actuator contact member is thereby depressed and the stressed contact member is moved to the second position thereof. The switch preferably further comprises an intermediate actuator member which is interposed between the actuator contact member and the stressed contact member and electrically insulated from the actuator contact member. The intermediate actuator member is preferably mounted in the housing so that it is operative for securing the stressed contact member in the housing and so that it is depressible to depress the stressed contact member in order to move it to the second position thereof. The cover portion of the housing of the switch construction preferably comprises a first portion which is depressible to independently depress the first blade member of the second contact assembly and a second portion which is spaced from the first portion and depressible to independently depress the second blade member of the second contact assembly. In the preferred application of the switch construction of the instant invention, it is utilized in combination with a diode which is electrically connected between the fourth and fifth terminals on the exterior of the housing. It is also preferably utilized in combination with a waterproof power cord comprising first and second waterproof wire elements, the first wire element being electrically connected in waterproof relation to one of the first or second terminals, and the second wire element being electrically connected in waterproof relation to either the third terminal or to both of the fourth and fifth terminals.

For use and operation of the switch construction of the instant invention, it is electrically connected in an electrical appliance between a power cord and the operative electrical circuitry of the appliance, and preferably a diode is connected between the fourth and fifth terminals on the exterior of the housing. Accordingly, by manually depressing the first portion of the cover portion of the housing, the first blade element is manually depressed to electrically connect it to the actuator contact member and to electrically connect the stressed contact member to the fixed contact. As a result, electrical continuity is provided between the third terminal and the fourth terminal, and electrical continuity is also provided between the first terminal and the second terminal so that the appliance to which the switch is connected is electrically energized. Alternatively, the appliance can also be energized by depressing the second portion of the cover portion of the housing to independently depress the second blade element to a position of engagement with the actuator contact member and to also thereby depress the stressed contact member to a position of engagement with a fixed contact. In this regard, when the switch construction is utilized in combination with a diode which is electrically connected between the fourth and fifth terminals, one actuated position of the switch causes full power to be passed to the appliance, whereas the other actuated position of the switch causes the appliance to be operated at half power. In either case, however, if manual pressure is released from the cover portion of the switch, electrical continuity is interrupted in both the first contact assembly and the second contact assembly so that both sides of the circuit which lead to the appliance are electrically interrupted. Further, since the switch construction is preferably connected to a power cord in waterproof relation, the switch cannot normally be short circuited even if the appliance to which the switch is constructed and the switch itself are both immersed in a pool of water, so that a person bathing in a pool of water cannot normally be electrocuted.

Accordingly, it is a primary object of the instant invention to provide a switch construction for small appliances which is operable with increased safety.

Another object of the instant invention is to provide a waterproof switch construction which can be utilized to effect and interrupt electrical continuity in two lines of an electrical circuit by manipulating a portion of a cover of a housing of the switch.

A still further object of the instant invention is to provide an effective switch construction which can be utilized for an appliance, such as a hair dryer or the like, but which is not normally short circuited in the event that the appliance is accidentally immersed in a pool of water.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
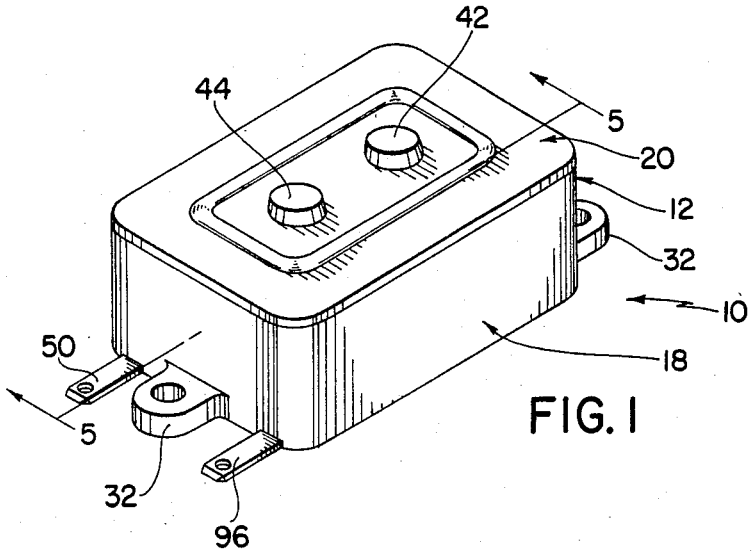
FIG. 1 is a perspective view of the switch construction of the instant invention.
Figure 2:
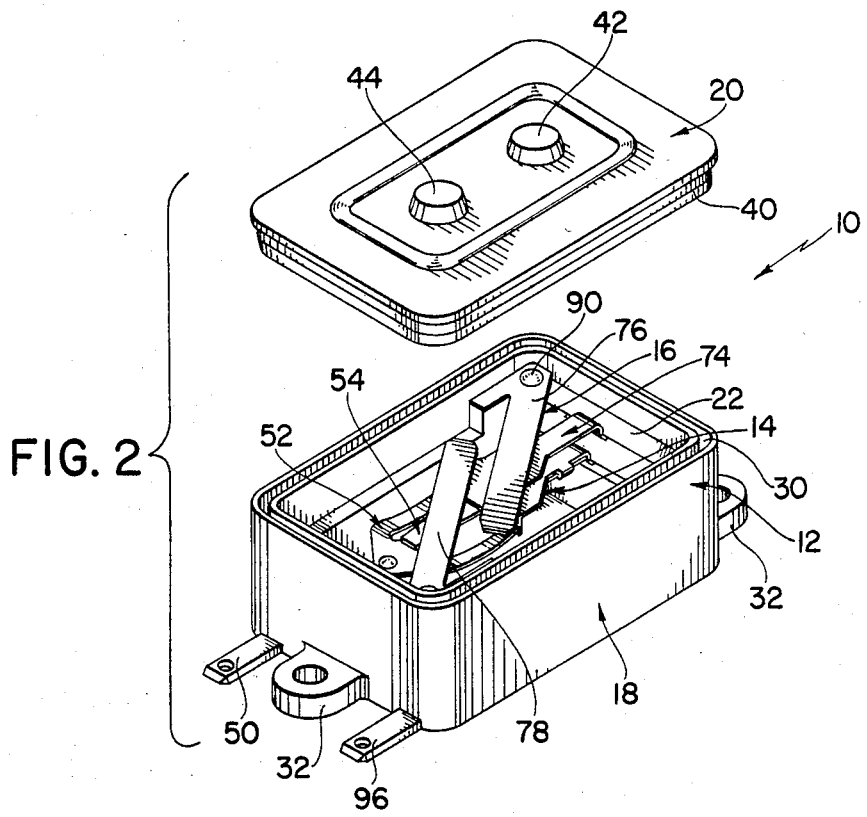
FIG. 2 is a perspective view thereof with the cover portion of the housing removed.
Figure 3:
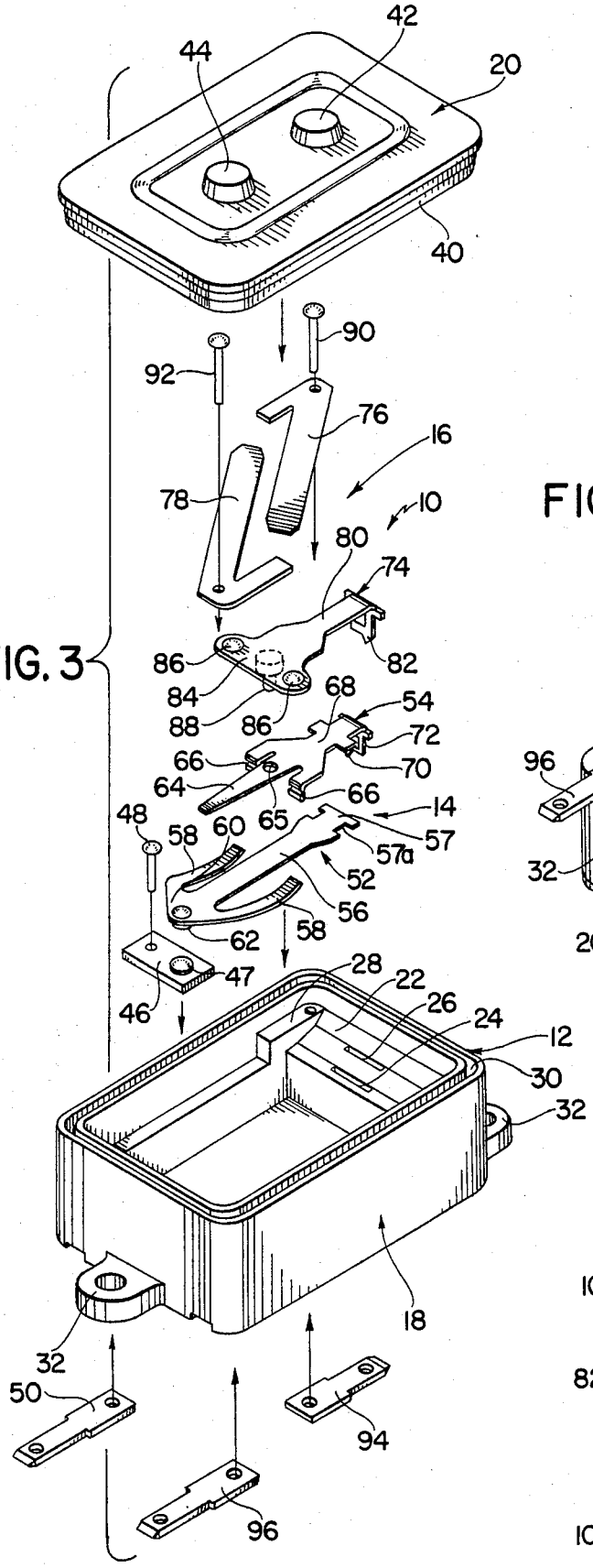
FIG. 3 is an exploded perspective view of the switch construction.

Referring now to the drawings, the switch construction of the instant invention is illustrated and generally indicated at 10 in FIGS. 1 through 8, and it comprises a housing generally indicated at 12, and first and second contact assemblies generally indicated at 14 and 16, respectively, which are operative for effecting and interrupting electrical continuity between various electrical terminals mounted on the exterior of the housing 12, as will hereinafter be more fully set forth.

The housing 12 comprises a main casing generally indicated at 18 and a cover generally indicated at 20. The main casing 18 is preferably integrally molded from a suitable electrical insulating material, such as Nylon (duPont TM), in a generally rectangular open box-like configuration. Integrally formed in the interior of the casing 18 is an inclined shelf 22 having downwardly extending first and second slots 24 and 26, respectively, therein and integrally formed adjacent diagonally opposite corners of the casing 18 are mounting ridges 28. A recessed channel 30 is provided along the upper peripheral edge of the casing 18, and apertured mounting tabs 32 are integrally formed on the bottom portion of the casing 18 for mounting the switch 10 on an appliance. Formed on the bottom side of the casing 18 is a rectangular nest 34 with which the slots 24 and 26 communicate, and a rubberized seal 36 extends around the slots 24 and 26 in the nest 34. A pair of mounting posts 38 having threaded apertures therein extend downwardly from the bottom of the casing 18 adjacent the nest 34 for securing a power cord to the switch construction 10 in a manner which will hereinafter be more fully set forth. The cover 20 is preferably integrally molded from a resilient rubberized material having a relatively low durometer, and it is dimensioned and configured to be received in waterproof sealing relation on the casing 18. In this connection, the cover 20 includes a downwardly extending seal or rim 40 which is dimensioned and configured to be received and secured in the channel 30 in the casing 18 in order to achieve a watertight seal between the casing 18 and the cover 20. Formed on the upper side of the interior portion of the cover 20 are first and second spaced buttons 42 and 44, respectively, and correspondingly positioned first and second spaced bumps **42*a* and 44*a*, respectively, are formed on the underside of the interior portion of the cover 20**.

The first contact assembly 14 comprises a fixed contact 46 which includes a fixed contact element 47 and which is secured in the lower interior portion of the casing 18 with a rivet 48. The rivet 48 extends through the fixed contact 46 and it extends in waterproof relation through the casing 18 to the bottom or underside thereof where it secures a first terminal 50 in the switch 10 so that the first terminal 50 is electrically connected to the fixed contact 46. The first contact assembly 14 further comprises a stressed contact member generally indicated at 52 and an intermediate actuator member generally indicated at 54 which secures the stressed contact member 52 in the casing 18. In this connection, the main portion of the stressed contact member 52 is preferably integrally struck from a resilient sheet metal, such as bronze, and it comprises a center leaf 56 having a fixed end 57 and a pair of notches 57a adjacent the fixed end 57, a pair of side leaves 58 which are integrally interconnected to the center leaf adjacent a free end 60 of the stressed contact member 52, and a contact element 62 which is secured on the stressed contact member 52 adjacent the free end 60. The intermediate actuator member 54 is preferably also integrally struck from a suitable sheet metal, and it comprises an elongated center arm 64 having an aperture 65 therein adjacent the base therof and a pair of notched tabs 66 which extend downwardly adjacent opposite sides of the base of the arm 64. Also included in the intermediate actuator member 54 is a stem portion 68 to which the arm 64 is integrally attached at its base, and a pair of retainer tabs 70 and a pointed contact prong 72 extend downwardly from the stem portion 68. In assembled relation, the retainer tabs 70 are received in the notches 57*a* in the center leaf 56 of the stressed contact member 52, and the terminal ends of the side leaves 58 are received in the notches in the tabs 66 of the intermediate actuator member 54. The intermediate actuator member 54 and the stressed contact member 52 are dimensioned and configured so that when they are received in assembled relation in this manner, the side leaves 58 are compressed and therefore maintained in at least slightly bowed dispositions whereby the center leaf 56 is maintained under tension. The stressed contact member 52 and the intermediate actuator member 54 are assembled as a unit in the lower portion of the casing 18 with the pointed prong 72 received and secured in waterproof relation in the first slot 24 so that it projects into the nest 38. Accordingly, the intermediate actuator member 54 secures the stressed contact member 52 in the housing 12, and the prong 72 defines a second contact on the exterior of the housing 12 which is electrically connected to the stressed contact member 52.

The second contact assembly 16 is located immediately above the first contact assembly 14 in the casing 18, and it comprises an actuator contact member generally indicated at 74 and first and second resilient blade members 76 and 78, respectively. The actuator contact member 74 preferably comprises a main portion 80 and a downwardly extending pointed prong 82 which are preferably integrally struck from a suitable resilient sheet metal, such as bronze. The main portion 80 has an enlarged free end 84, and a pair of spaced electrically conductive contact elements 86 are secured on the upper surface of the free end 84. An actuator pin 88 which is made of an electrical insulating material, such as Nylon (duPont TM), extends downwardly from the bottom side of the enlarged free end 84. The actuator contact member 74 is secured in the casing 18 with the pointed prong 82 which is received and secured in waterproof relation in the slot 26 so that it projects into the nest 34 to define a third terminal on the exterior of the housing 12. Further, the actuator contact member 74 is dimensioned so that when it is assembled in the casing 18 in this manner, the terminal end of the actuator pin 88 is aligned with the aperture 65 in the actuator arm 64 and so that the entire main portion 80 is disposed in spaced relation above the intermediate actuator member 54. In this connection, the actuator pin 88 is preferably dimensioned so that only the terminal end portion thereof is receivable in the aperture 65 so that the actuator pin 88 can be effectively used for moving the actuator arm 64 downwardly into engagement with the stressed contact member 52. The resilient blade members 76 and 78 are preferably also made of a resilient sheet metal, and they are preferably each made in the configuration of the number "7". The first and second blade members 76 and 78 are preferably secured on the ridges 28 in diagonally opposite corners of the casing 18 so that they extend inwardly in the casing 18 in spaced relation to each other and so that each of the blade members 76 and 78 passes immediately above one of the contact elements 86 on the actuator contact member 74. The first and second blade members 76 and 78 are secured on their respective ridges 28 in the casing 18 with rivets 90 and 92, respectively, which extend in waterproof relation through the casing 18 to the bottom end thereof, and fourth and fifth electrical terminals 94 and 96 are assembled and secured on the ends of the rivets 90 and 92, respectively, on the exterior of the casing 18. Accordingly, the first and second blade members 76 and 78 are electrically connected to the fourth and fifth terminals 94 and 96, respectively, on the exterior of the casing 18 by means of the rivets 90 and 92, respectively.

Figure 4:
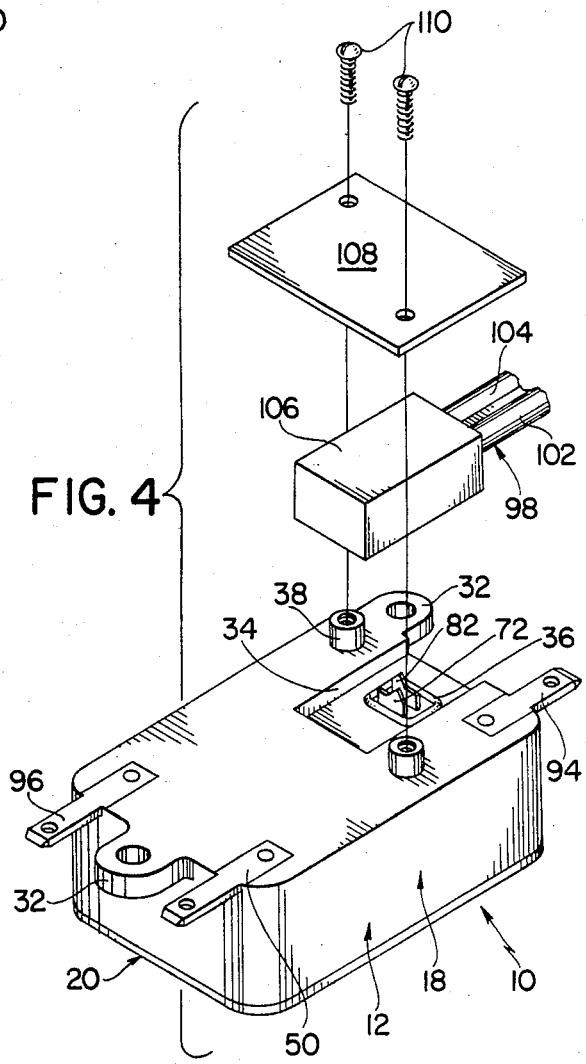
FIG. 4 is a bottom exploded perspective view thereof.

Referring now to FIG. 4, the switch 10 is preferably utilized in combination with a waterproof power cord of the type illustrated and generally indicated at 98. The power cord 98 preferably comprises first and second insulated, waterproof power cord wire elements 102 and 104, respectively, which terminate in a waterproof rubberized end piece 106. The end piece 106 is preferably dimensioned to be snugly received in the nest 34 so that the pointed prong 72 on the intermediate actuator member 54 pierces the end piece 106 to electrically connect it to the first power cord element 102, and so that the pointed prong 82 on the actuator contact member 74 pierces the end piece 106 to electrically connect it to the second power cord element 104. A retainer plate 108 is provided for securing the end piece 106 in the nest 34, and a pair of screws 110 are provided for securing the retainer plate 108 to the casing 18, the screws 110 being receivable in the threaded posts 38 to secure the plate 108 to the casing 18 so that it urges the end piece 106 inwardly into the nest 34. When the end piece 106 is secured in the nest 34 in this manner, the prongs 72 and 82 are electrically connected to the power cord elements 102 and 104, respectively, and the seal 36 embraces the inner side of the end piece 106 to provide a waterproof seal between the prongs 72 and 82 and the power cord elements 102 and 104. Further, although the switch 10 is adapted to be connected to the power cord 98 so that the power cord elements 102 and 104 are connected to the second and third terminals, i.e., prongs 72 and 82, respectively, it will be understood that other embodiments of the switch are contemplated wherein one or both of the first and fourth terminals 50 and 94, respectively, are adapted to be connected to a power cord instead of the prongs 72 and 82, respectively.

Figure 8:
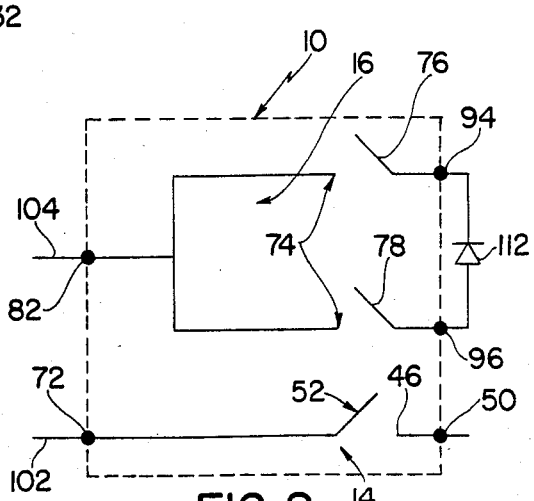
FIG. 8 is a schematic view of the switch construction in a circuit.
Figure 5:
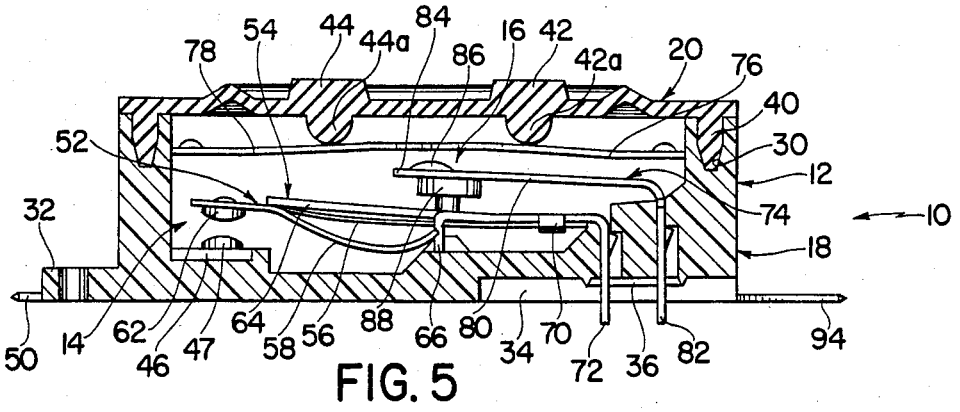
FIG. 5 is a sectional view taken along line 5—5 in FIG. 1.
Figure 6:
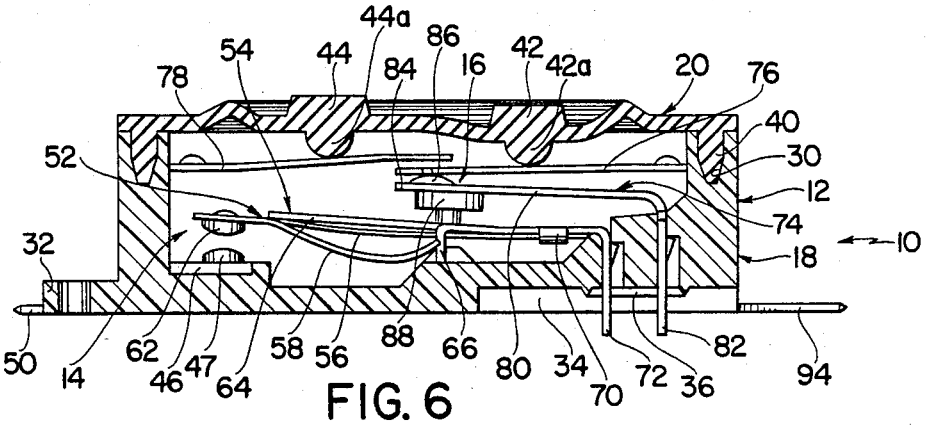
FIGS. 6 and 7 are similar sectional views illustrating the sequential operation of the switch construction.
Figure 7:
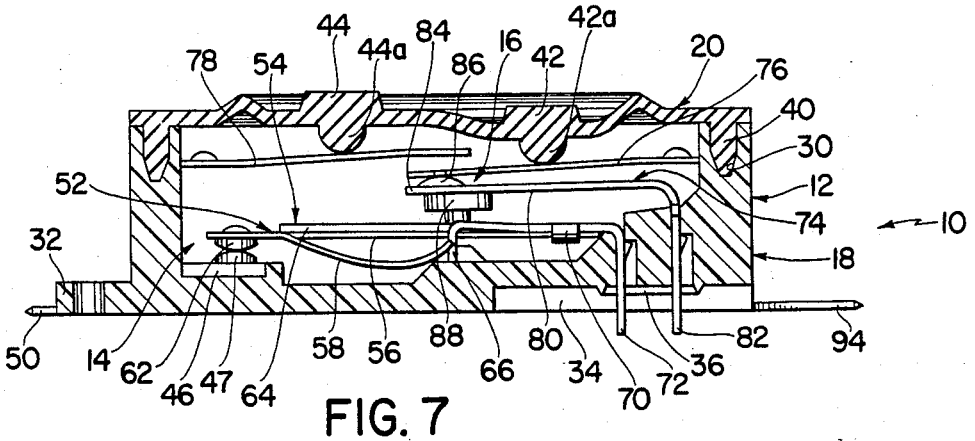

Referring to FIG. 8, the switch 10 is schematically illustrated. As will be seen, the switch 10 is preferably utilized in combination with a diode or diode means 112 which is preferably electrically connected between the fourth and fifth terminals 94 and 96, respectively. As a result, the switch 10 can be electrically connected to a small appliance so that the appliance is operable at two different power levels, as will hereinafter be more fully set forth.

For use and operation of the switch 10, it is electrically connected to the power cord 98 in the manner hereinabove set forth, the diode 112 is electrically connected across the fourth and fifth terminals 94 and 96, respectively, and the fourth terminal 94 and the first terminal 50 are electrically connected to a small appliance, such as a hair dryer. The hair dryer can then be energized through the switch 10 by depressing one of the buttons 42 or 44 to make an electrical connection between the second power cord element 104 and the terminal 94 through the second contact assembly 16 and also to make an electrical connection between the power cord element 102 and the first terminal 50 through the first contact assembly 14. In this regard, when the first button 42 is depressed, the bump 42*a* engages the first blade member 76 to deflect it to a position of engagement with one of the contact elements 86 on the actuator contact member 74 so that electrical continuity is effected between the second power cord element 104 and the fourth terminal 94. As the button 42 is further depressed, the actuator contact member 74 is moved downwardly so that the pin 88 thereon engages the intermediate actuator member 54 to move it downwardly and to thereby move the center leaf 56 of the stressed contact member 52 downwardly. Finally, after the center leaf 56 has been moved downwardly a sufficient amount, the free end 60 thereof is moved downwardly with a snap action so that the contact element 62 thereon engages the contact element 47 on the fixed contact 46 to effect electrical continuity between the first power cord element 102 and the first terminal 50 and the appliance is operated in a high-power mode. However, because of the manner in which the switch is constructed, as soon as pressure is released from the button 42, the first and second contact assemblies 14 and 16, respectively, automatically return to their original positions, and electrical continuity is interrupted between the appliance and both of the power cord elements 102 and 104. In order to operate the appliance attached to the switch 10 in a low-power condition, the button 44 is manually depressed to independently depress the blade 78 so that it contacts one of the contact elements 86 to effect electrical continuity between the fifth terminal element 96 and the second power cord element 104 and to effect continuity in the first contact assembly 14 in the manner hereinabove set forth. When the first and second contact assemblies 14 and 16 are actuated in this manner, electrical continuity is effected between the first power cord element 102 and the first terminal 50, and between the second power cord element 104 and the fourth terminal 94 through the diode 112; and since the diode 112 effectively reduces the amount of power which passes through the terminal 94 by approximately 50 percent, the appliance is operated in a low-power mode.

It is seen, therefore, that the instant invention provides an effective switch construction which can be utilized for controlling the operation of a small appliance with increased safety. The switch 10 can be operated for controlling the operation of an appliance in both low- and high-power modes by manually depressing the appropriate button 42 or 44 and holding it in a depressed position. However, the switch is constructed so that as soon as the depressed button 42 or 44 is released, the contact assemblies 14 and 16 return to their unactuated positions, and electrical continuity is interrupted in both the first and second contact assemblies 14 and 16. As a result, if the switch 10 is accidentally dropped in a pool of water, the contact assemblies 14 and 16 are automatically deactuated, and a circuit cannot be completed between the power cord elements 102 and 104 so that the risk of electrocuting a person in the pool of water is substantially reduced. Accordingly, it is seen that for these reasons, as well as the other reasons hereinabove set forth, the switch of the instant invention represents a significant advancement in the art which has substantial merit from a commercial standpoint as well as from a safety standpoint.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A switch construction comprising:

a. a housing;

b. a first contact assembly in said housing comprising;

i. a fixed contact electrically connected to a first terminal on the exterior of said housing; and ii. a resiliently movable stressed contact member electrically connected to a second terminal on the exterior of said housing and movable with a snap action between a first position wherein it is spaced from said fixed contact and a second position wherein it is in engagement therewith; and c. a second contact assembly in said housing comprising:

i. a resiliently movable actuator contact member electrically connected to a third terminal on the exterior of said housing and electrically insulated from said stressed contact member but depressible to move said stressed contact member from said first position thereof to said second position thereof; and ii. a first resilient blade member electrically connected to a fourth terminal on the exterior of said housing and engageable with said actuator contact member to first electrically interconnect said third and fourth terminals and to then depress said actuator contact member to thereby move said stressed contact member to said second position thereof.

2. In the switch construction of claim 1, said second contact assembly further comprising a second resilient blade member electrically connected to a fifth terminal on the exterior of said housing, said second blade member being spaced from said first blade member, said first and second blade members each being independently depressible to positions of engagement with said actuator contact member wherein said actuator contact member is thereby depressed and said stressed contact member is thereby moved to said second position thereof.

3. In the switch construction of claim 2, said housing comprising a main casing and a deformable cover on said main casing, a first portion of said cover being depressible to independently depress said first blade member, a second portion of said cover which is spaced from said first cover portion being depressible to independently depress said second blade member.

4. The switch construction of claim 2 in combination with diode means for operating said switch at two different power levels electrically connected between said fourth and fifth terminals.

5. The switch construction of claim 3 in combination with a power cord comprising first and second waterproof wire elements, said housing further characterized as a waterproof housing, said first power cord wire element being electrically connected in waterproof relation to one of said first or second terminals, said second power cord wire element being electrically connected in waterproof relation to either said third terminal or to both of said fourth and fifth terminals.

6. In the switch construction of claim 1, said first contact assembly further comprising an intermediate actuator member interposed between said actuator contact member and said stressed contact member, said actuator contact member being depressible to depress said intermediate actuator member to thereby move said stressed contact member to said second position thereof.

7. In the switch construction of claim 6, said actuator contact member being electrically insulated from said intermediate actuator member and being adapted for securing said stressed contact member in said housing, said stressed contact member being electrically connected to said second terminal through said intermediate actuator member.

8. In the switch construction of claim 1, said stressed contact member having a free end, being integrally struck from a sheet metal, and comprising a center leaf and two side leaves, said center and side leaves having first ends which are integrally connected adjacent said free end and second ends which are secured in said switch so that said two side leaves are in compression and said center leaf is in tension to make the free end of said stressed contact member operable with a snap action, said free end engaging said fixed contact when said stressed contact member is in said second position thereof.

9. The switch construction claim 1 in combination with a waterproof power cord comprising first and second waterproof wire elements, said housing further characterized as a waterproof housing comprising a main casing portion and a deformable cover on said main casing portion, said cover being depressible to depress said first blade member, said first wire element being electrically connected in waterproof relation to one of said first or second terminals, said second power cord wire element being electrically connected in waterproof relation to one of said third or fourth terminals.

* * * * *